US007946294B2

(12) United States Patent
Sherwood

(10) Patent No.: US 7,946,294 B2
(45) Date of Patent: May 24, 2011

(54) SEALED CIGARETTE FILTER

(75) Inventor: Timothy S. Sherwood, Midlothian, VA (US)

(73) Assignee: Philip Morris USA Inc., Richmond, VA (US)

( * ) Notice: Subject to any disclaimer, the term of this patent is extended or adjusted under 35 U.S.C. 154(b) by 702 days.

(21) Appl. No.: 12/000,865

(22) Filed: Dec. 18, 2007

(65) Prior Publication Data

US 2008/0185011 A1 Aug. 7, 2008

Related U.S. Application Data

(60) Provisional application No. 60/877,639, filed on Dec. 29, 2006.

(51) Int. Cl.
*A24D 3/06* (2006.01)
*A24F 11/00* (2006.01)
*A24B 15/00* (2006.01)

(52) U.S. Cl. ..... 131/337; 131/335; 131/328; 131/331

(58) Field of Classification Search ..... 131/337, 131/335, 331, 328
See application file for complete search history.

(56) References Cited

U.S. PATENT DOCUMENTS

| | | | | |
|---|---|---|---|---|
| 2,808,057 | A | 10/1957 | Jaksch | |
| 3,596,665 | A | 8/1971 | Lindgard | |
| 3,635,226 | A | 1/1972 | Horsewell et al. | |
| 3,705,588 | A | 12/1972 | Tamol et al. | |
| 3,805,799 | A | 4/1974 | Stewart et al. | |
| 4,966,171 | A | 10/1990 | Serrano et al. | |
| 4,991,605 | A * | 2/1991 | Keritsis | 131/335 |
| 5,016,655 | A * | 5/1991 | Waddell et al. | 131/310 |
| 5,331,981 | A | 7/1994 | Tamaoki et al. | |
| 5,499,636 | A | 3/1996 | Bagget, Jr. et al. | |
| 5,666,976 | A | 9/1997 | Adams et al. | |
| 5,692,525 | A | 12/1997 | Counts et al. | |
| 5,692,526 | A | 12/1997 | Adams et al. | |
| 5,915,387 | A | 6/1999 | Baggett, Jr. et al. | |
| 5,988,176 | A | 11/1999 | Baggett, Jr. et al. | |
| 6,026,820 | A | 2/2000 | Baggett, Jr. et al. | |
| 6,209,547 | B1 | 4/2001 | Koller et al. | |
| 6,595,218 | B1 | 7/2003 | Koller et al. | |
| 2004/0074507 | A1 | 4/2004 | Macadam et al. | |
| 2004/0261807 | A1 | 12/2004 | Dube et al. | |
| 2005/0066981 | A1 | 3/2005 | Crooks et al. | |
| 2007/0074733 | A1 * | 4/2007 | Rasouli et al. | 131/231 |

FOREIGN PATENT DOCUMENTS

| | | | |
|---|---|---|---|
| EP | 0276021 | A | 7/1988 |
| GB | 1234802 | | 6/1971 |
| GB | 1257290 | | 12/1971 |
| WO | WO2006051422 | A | 5/2006 |
| WO | WO2006082529 | A | 8/2006 |
| WO | WO2006117697 | A | 11/2006 |

OTHER PUBLICATIONS

International Search Report and Written Opinion dated Jul. 18, 2008 for PCT/IB2007/004478.
International Preliminary Report on Patentability mailed Jul. 9, 2009 for PCT/IB2007/004478.

* cited by examiner

*Primary Examiner* — Richard Crispino
*Assistant Examiner* — Dionne W Mayes
(74) *Attorney, Agent, or Firm* — Buchanan Ingersoll & Rooney PC

(57) ABSTRACT

Smoking articles, such as cigarettes and cigarette filters, methods of manufacturing smoking articles including sealed filters, and methods of treating tobacco smoke are provided. In one exemplary embodiment, a smoking article contains sealed filters, wherein additives are sealed within the sealed filters.

14 Claims, 4 Drawing Sheets

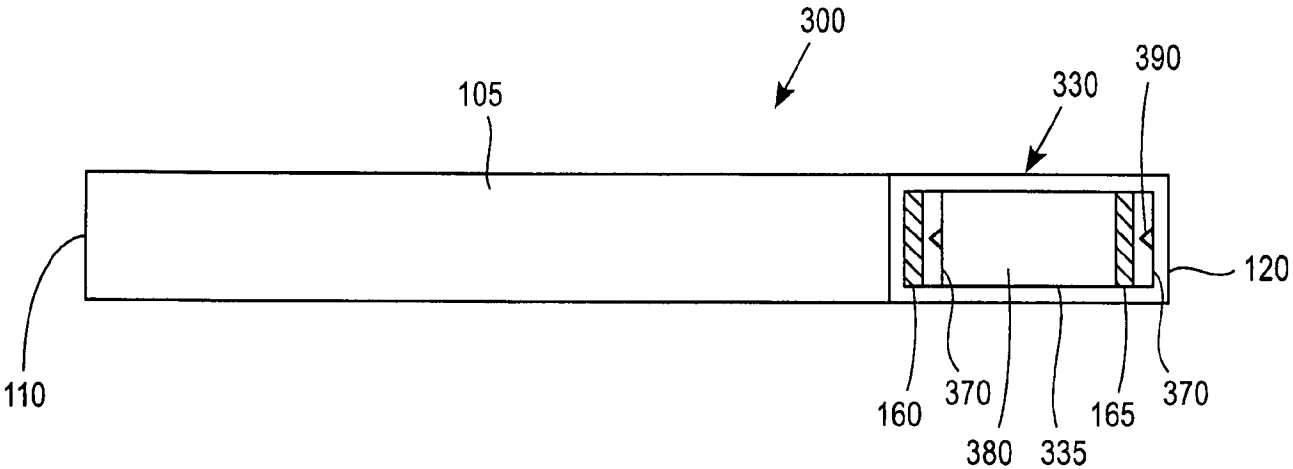
FIG. 3A
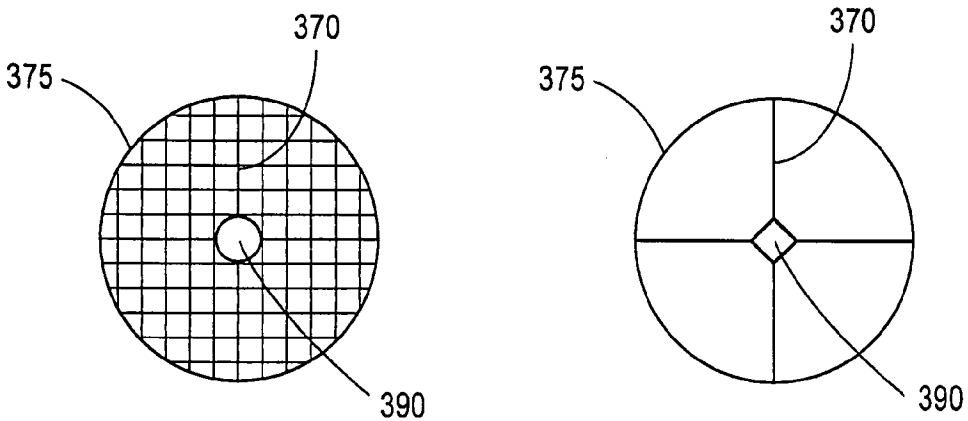
FIG. 3B
FIG. 3C
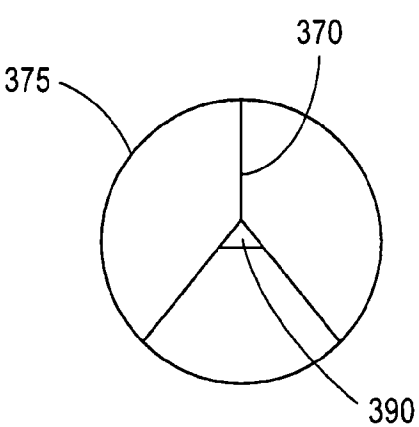
FIG. 3D

SEALED CIGARETTE FILTER

CROSS REFERENCE TO RELATED APPLICATION

This application claims priority under 35 U.S.C. §119(e) to U.S. Provisional Application No. 60/877,639, filed on Dec. 29, 2006, the entire content of which is incorporated herein by reference.

BACKGROUND

Additives and sorbents have been added to cigarettes to change the properties of mainstream smoke delivered to a smoker. However, additives within cigarettes can be lost due to environmental losses, such as evaporation, as well as losses caused by sorbents such as absorbents and adsorbents in cigarettes. Additionally, sorbents within cigarettes can negatively impact a cigarette during storage, such as by removing flavor from the cut filler or absorbing or adsorbing additives, causing not only the loss of the taste and additive properties, but also loss of sorption properties caused by the sorption on to surfaces of the sorbents. Thus, there is interest in isolating both additives and sorbents within cigarettes to reduce their interactions within other components of the cigarette, as well as the environment.

SUMMARY

A pressure sensitive sealed cigarette filter is provided herein to reduce interactions between additives and/or sorbents (hereinafter collectively referred to as "additives") with the environment and other components of cigarettes during storage and prior to smoking. By providing a pressure sensitive sealed cigarette filter, additives can be held within one or more cavities formed by a non-permeable housing or tube surrounding a circumference of the one or more cavities and one or more pressure sensitive, non-permeable or low permeable films enclosing end portions of the one or more cavities. Additionally, by providing one or more pressure sensitive, non-permeable or low permeable films, the films can be used to compartmentalize each of the cavities and seal them apart from other cavities as well, wherein upon application of a predetermined pressure level, the films can be broken, and thus the seals can be broken and the additives can be exposed to mainstream smoke.

In a first embodiment, a cigarette, comprises a tobacco rod, a sealed filter adjacent to a downstream end of the tobacco rod, wherein the sealed filter comprises a housing with a stepped inner profile, a cavity within the housing, a first film sealing an upstream end of the cavity on a first step of the stepped inner profile, and a second film sealing a downstream end of the cavity on a second step of the stepped inner profile, wherein the cavity is located between the first film and the second film sealing a downstream end of the cavity; and tipping paper attaching the tobacco rod to the sealed filter.

In another embodiment, a sealed cigarette filter comprises a housing, a cavity within the housing, a first film on a first side of the cavity, a second film on a second side of the cavity, and at least one piercing device located next to the first film and/or the second film.

BRIEF DESCRIPTION OF THE DRAWING FIGURES

FIG. 3A illustrates another exemplary embodiment cigarette including an embodiment of a pressure sensitive sealed filter, and a path of fluid flow through the cigarette.

FIGS. 3B-3D illustrate cross-sectional views of exemplary embodiment piercing devices and their structural support devices.

DETAILED DESCRIPTION

Smoking articles are provided that include pressure sensitive sealed cigarette filters therein. In exemplary embodiments, pressure sensitive cigarette filters are provided such that within the filters, one or more cavities can be sealed therein using pressure sensitive sealing films. By sealing cavities within filters, additives (and/or sorbents, collectively referred to primarily as "additives," as mentioned above) can be provided in a cigarette filter, and can also be isolated from interaction with the cigarette and environment prior to unsealing the cavities. Additionally, the seals can be breached or otherwise degraded using air pressure (i.e., drawing on the cigarette) such that the cavities are unsealed. In other words, before smoking, pressure sensitive sealed cigarette filters can be used to isolate additives within cavities within cigarette filters; and during smoking, the seals can be breached to allow air and mainstream smoke to pass through the cavities.

Figure 1:
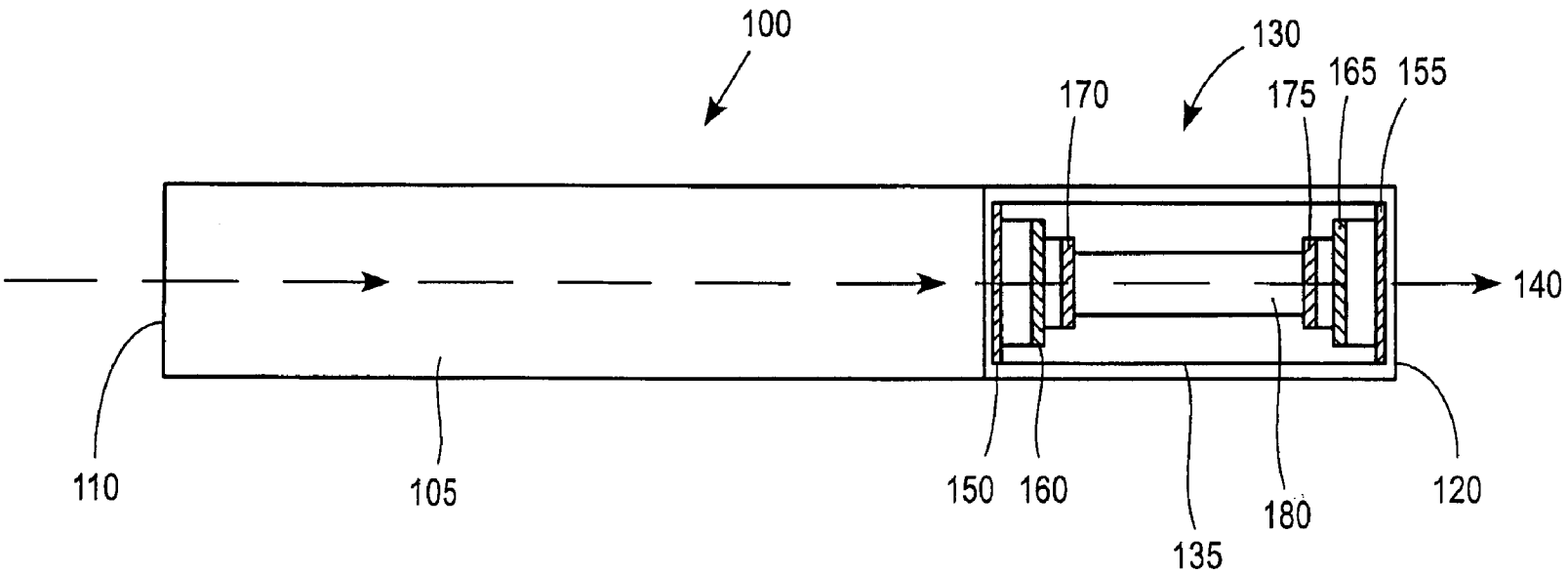
FIG. 1 illustrates an exemplary embodiment cigarette including a pressure sensitive sealed filter, and a path of fluid flow through the cigarette.

In an exemplary embodiment, a cigarette 100 with a pressure sensitive sealed cigarette filter, as illustrated in FIG. 1, is provided. As illustrated in FIG. 1, an exemplary cigarette 100 includes an upstream end 110, a tobacco rod 105, a pressure sensitive sealed filter section 130 and a downstream end 120.

Within the filter section 130, a non-permeable (or low permeable) housing 135, which can be in the form of a tube, as well as two (or more) pressure sensitive films 160, 165 on open ends of the housing 135, can be provided in order to seal the cavity 180 within the housing 135. In exemplary embodiments, the housing 135 and the films 160, 165 are non-permeable or low permeable in that the interior of the cavity 180 is substantially isolated from interaction with the environment or other parts of the cigarette 100.

In exemplary embodiments, the cavity 180 of the sealed filter can be breached or ruptured by the smoker physically causing breaking, tearing, opening up or otherwise degrading the pressure sensitive films 160, 165 due to mechanical force, air pressure, chemical reaction or other technique (hereinafter collectively referred to as "breaching") such that the cavity 180 is accessible to pass mainstream smoke therethrough. In exemplary embodiments, breaching the films 160, 165 can be accomplished by exceeding a predetermined pressure level (i.e., drawing on the downstream end 120 of the cigarette 100), wherein the pressure with or without additional aid is sufficient to unseal the filter and allow mainstream smoke into the cavity 180.

Therefore, as illustrated in FIG. 1, in a preferred embodiment, when smoking the exemplary cigarette 100, a draw or a puff would cause a breaching of the films 160, 165 (e.g., 165 can be breached and then 160 can be breached), whereupon a smoke feed 140 (i.e., a flow of mainstream tobacco smoke) would travel in a downstream direction from the upstream end 110 through a tobacco rod 105 then through a filter section 130 (including an optional first screen 150, a breached first film 160, and an optional second screen 170, a cavity 180, an optional third screen 175, a breached second film 165, and an optional fourth screen 155) before exiting the downstream end 120 of the cigarette 100.

Sealed Filters

The sealed filters provide advantages particularly for cigarettes containing additives. By providing additives within sealed filters, loss and/or sorption of or by additives can be substantially reduced during storage, and additives can be released or accessed by breaching or otherwise unsealing the sealed filters.

By sealing additives within the filter, containment of additives to substantially avoid or minimize unwanted migration or sorption, such as, for example, during storage can be achieved. Additionally, by providing a sealed cigarette filter, which can include pressure sensitive seals, additives in the sealed filter can be accessible enough to mainstream smoke when, for example, the seals of the sealed filter are breached by pressure (i.e., a drawing action). For example, the sealed filters may be breached by drawing on a cigarette, thus breaching films sealing the sealed filter and allowing interaction between the additives from within the sealed filter and the mainstream smoke passing therethrough.

In exemplary embodiments, the seals of exemplary sealed filters are formed from pressure sensitive thin films. As a result, due to their pressure sensitivity, the films can be breached (ruptured) or otherwise unsealed by pressure to allow mainstream smoke to pass through a cavity within the sealed filter.

In addition to the pressure sensitivity of the films, additional measures can be provided to assist in the rupturing or breaking of the films. For example, the films can be weakened uniformly or nonuniformly by scoring or perforating surfaces of the films as desired. Alternatively, structural additions to the filters, such as roughened surfaces, protrusions or pins, can be provided to assist in the rupturing or breaking of the films. For example, pins can be provided, wherein the films are sufficiently flexible under pressure due to a smoker drawing on the filter to flex a portion into contact with the pins, and wherein when the pins contact the films, the films can be punctured or broken by a pointed surface or protrusion of the pins.

Figure 2:
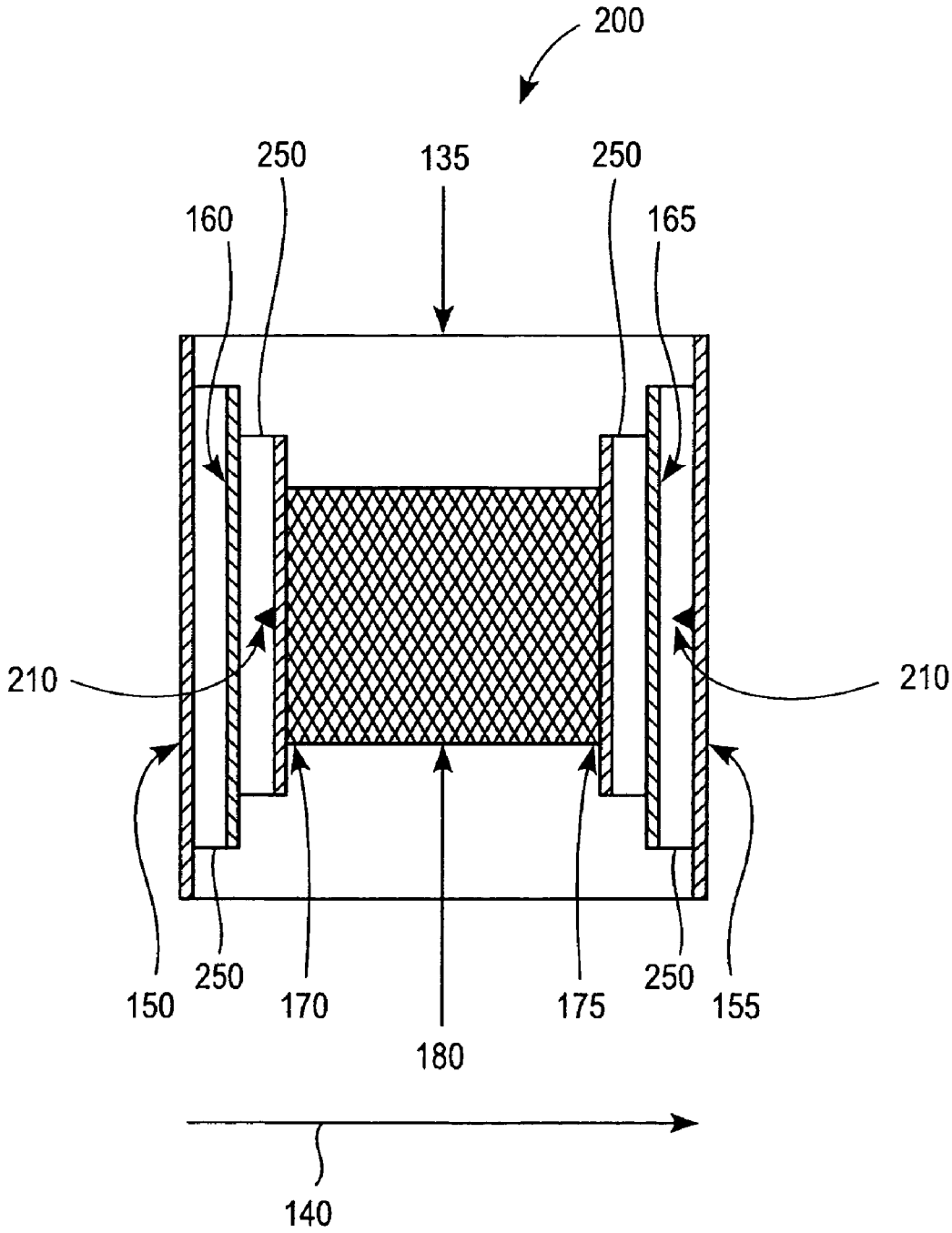
FIG. 2 illustrates another exemplary pressure sensitive sealed filter with a cavity therein.

In an exemplary embodiment, as illustrated in FIG. 2, a sealed filter 200 can include pins 210 located on downstream optional screens 170, 175 for assisting in breaching pressure sensitive sealing films 160, 165. By providing pins or other static mechanical devices, films 160, 165 when placed under pressure by inhalation on the downstream end 120 of a cigarette 100 can cause the films 160, 165 to flex and bend in the downstream direction 140 (e.g., if film 165 is breached first, then downstream film 160 can experience the draw, and can flex and be breached because of the air pressure on the film 160 after the film 165 is breached) and into contact with the tips of the pins 210. Upon contact of the films 160, 165 with the pins 210, the pins can pierce a surface of the films 160, 165, respectively, in order to breach or assist in the breaching of the films.

Additionally, by providing filters sealed with films, one or more cavities can be sealed by the films. In other words, a filter can be sealed at the ends, as well as within the body of the filter, to form several sealed segments therein. For example, two adjacent cavities can be formed by sealing a cavity using a pair of films on either end, and the cavity can be split by separating the single cavity into two cavities using a third film located between the pair of films.

Figure 4:
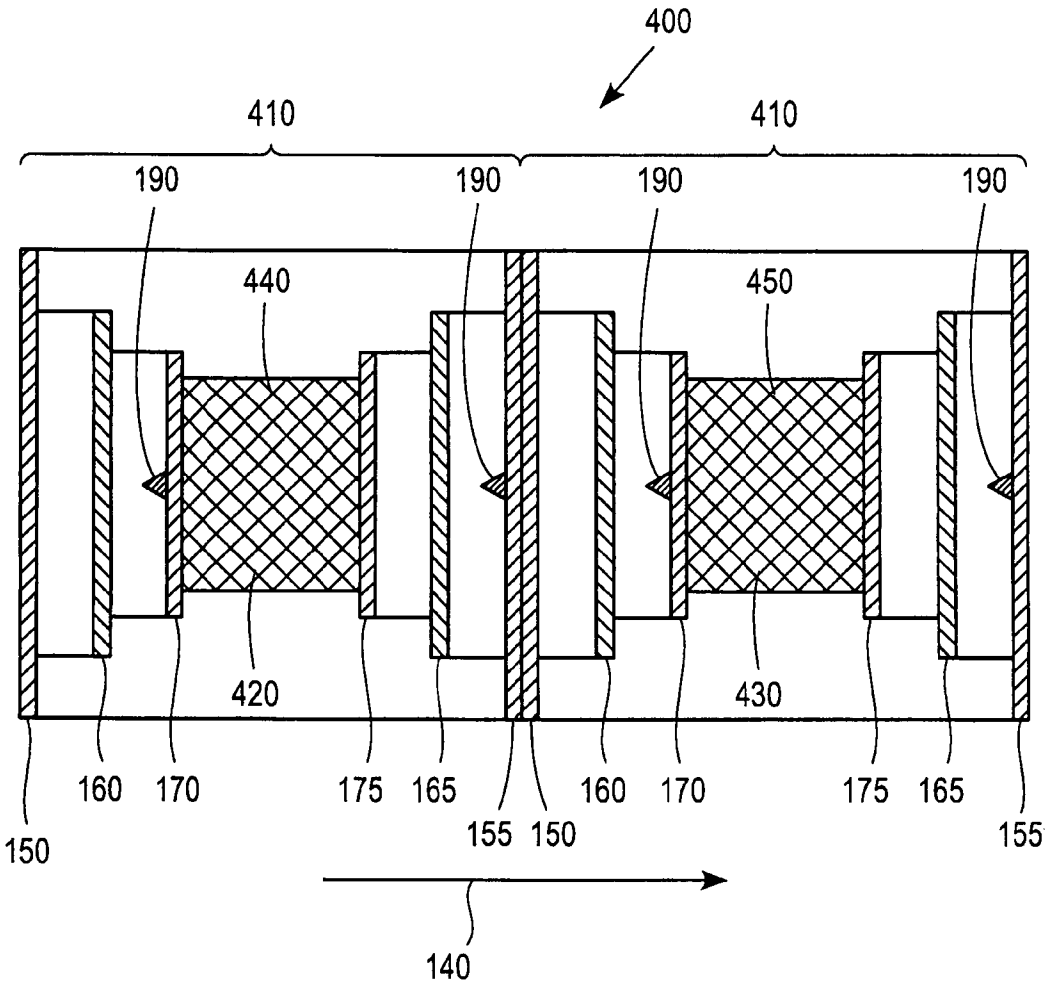
FIG. 4 illustrates another exemplary pressure sensitive sealed filter with two cavities therein.

In another exemplary embodiment, as illustrated in FIG. 4, more than one cavity can be provided in a filter 400. As illustrated in FIG. 4, more than one filter region, each with a cavity and sealed portions on either end, can be formed within a single filter by separating each region with one or more films.

Additionally, additives can be provided within one or more cavities in a sealed filter. By providing more than one cavity, more than one additive can be provided in a sealed filter, wherein each additive can be provided in a cavity of a separate filter region. Thus, in the filter illustrated in FIG. 4, for example, a first additive, such as a flavor, can be provided in a first cavity of a filter, while a second additive, such as a sorbent like activated carbon, can be provided in a second cavity of the filter.

In exemplary embodiments, a sealed filter is provided with more than one cavity. For example, as illustrated in FIG. 4, a filter 400 can include two compartments 410 abutted next to each other, wherein a first additive 420, such as a sorbent, can be placed in an upstream cavity 440, and a second additive 430, such as one or more flavorants, can be added into a downstream cavity 450. Additionally, if two or more compartments are intended to be abutted next to each other only one film would be required to separate the cavities thereby freeing space to form larger cavities to hold larger amounts of the additives.

By providing a multiple cavity, multiple compartment filter 400, mainstream smoke can pass in direction 140 through a first cavity 440 and interact with the first additive 420, then can pass through the second cavity 450 and interact with a second additive 430 before being delivered to a smoker. Additionally, by providing this type of filter, a first additive 420, as well as a second additive 430, can be isolated from the environment, the remainder of the cigarette, as well as the other additive before smoking. Alternatively, multiple cavities can be placed within a single compartment filter, which can have a single compartment with two or more cavities therein; or multiple compartments with multiple cavities in each compartment can also be provided.

If additives are provided in a sealed filter, additional air and smoke permeable measures can also be provided to serve multiple purposes including, but not limited to, containing additives within cavity 180, separating films 160, 165 from the remainder of cigarette 100 (including protecting the films during manufacturing, as well as from the cigarette itself and the additives therein), as well as cavity 180, providing a mechanical piercing surface to rupture films 160, 165, mechanically strengthen the filter, and supporting pins and the like.

Exemplary optional air and smoke permeable measures include, but are not limited to, screens and structural members. The air and smoke permeable measures can be made of any material, such as a metal, ceramic or plastic, and can have higher or lower permeability levels based upon the material, as well as the structure of the filter. For example, the air and smoke permeable measures can be mesh material to provide higher permeability.

In exemplary embodiments, air and smoke permeable measures provide air and smoke permeability and can also provide desirable resistance to draw characteristics and additionally structural integrity based upon the design of the cigarette. For example, as illustrated in FIG. 3B, an air and smoke permeable measure 370 can be in the form of a screen, which can keep particulate matter within the cavity 380 and/or ruptured film material from escaping and being drawn through downstream end 120 of the cigarette 300 shown in FIG. 3A. Cigarette 300 includes a tobacco rod 105 and a filter section 330. Alternatively, as illustrated in FIGS. 3C and 3D, air and smoke permeable measures 370 can be linear supports such as radially extending wire/rib members 370 extending inwardly from annular member 375, which have minimal effects on resistance to draw characteristics. It is noted that the configurations of air and smoke permeable measures 370 in FIGS. 3C and 3D are illustrative and can be modified as desired.

As illustrated in FIGS. 1, 2, 3A, 3B, and 4, exemplary air and smoke permeable measures can be provided in the form of screens 150, 155, 170, 175, 370 wherein the mesh size of the screens can be sufficiently small to hold additives within cavities, as well as to protect the films until smoking and to contain ruptured films during smoking, if desired. These screens, as illustrated in FIGS. 1, 2, 3A, 3B, and 4, can be placed in a filter as an optional second screen 170 and an optional third screen 175 on either side of each cavity, wherein these optional screens 170, 175 can be used to prevent additives from leaving the cavity 180 before and after films 160, 165 are ruptured.

In addition to air and smoke permeable measures 150, 155, 170, 175, an additional pin or mechanical piercing device 390 can be incorporated into the filter, as mentioned above. In exemplary embodiments, mechanical piercing devices 390 can include, but are not limited to, surface irregularities, protuberances, projections in edged or acute pin, spike, or serrated surfaces, etc. These pins and other mechanical devices 390 can be suspended or included within screens or other structural members 370, such as those illustrated in FIGS. 3B, 3C and 3D.

Sealed filters can be used within any smoking article, like a traditional or non-traditional cigarette, e.g., in a cigarette filter of a cigarette. Non-traditional cigarettes include, by way of example, cigarettes for electrical smoking systems as described in commonly-assigned U.S. Pat. Nos. 6,026,820; 5,988,176; 5,915,387; 5,692,526; 5,692,525; 5,666,976; and 5,499,636, the disclosures of which are hereby incorporated by reference herein in their entireties. Other non-traditional cigarettes include those having a fuel element in the tobacco rod as described in U.S. Pat. No. 4,966,171, which is incorporated herein by reference in its entirety.

The films can be any pressure sensitive, frangible material, such as a polymer, which is capable of both sealing the housing, as well as breaking, rupturing or perforating under pressure on demand. Preferably, the film is made of an elastomeric polymer, such as a natural polymer (e.g., latex) or a synthetic polymer (e.g., nitrile). Alternatively, the films can also be made of non-elastomeric, relatively weak polymers, such as sugar or pectin, which can also be used to immobilize additives within the sealed filters, and thus preferably reduces dissipation of the additives until the films are breached.

Preferably, the pressure sensitive films are frangible thin films. In exemplary embodiments, the films can be between 1-10 mils thick depending on the strength required and the type of film used. For example, a 3 mil latex film can be used.

The films can be formed by any method capable of applying a film. For example, the films can be attached to a filter by mechanical fastening, such as by embedding, frictionally fitting or heat setting a portion of the film into a housing material, chemical fastening, such as by adhering the film to the housing or chemically interacting the film and the housing. For example, films can be applied by spraying a film forming material onto the outer surfaces of sealed filters and allowing for the film forming material to solidify into a film to provide an outer layer. Alternatively, films can be formed and stretched to form a thin film, and then heated and applied to a housing to set as a seal, such as by using a die set within the stepped areas of the housing.

The housing 135 of the filter, as mentioned above, can be made of a tube. Preferably, the housing is not air permeable, such that the filter will be sealed on all sides. The tube can be made of any non-permeable material, and is preferably structurally rigid, such that the cavity will be protected from unintended crushing. For example, the housing can be made of a solid, rigid thermoset polymer tube. In such a case, a thermoset plastic housing, such as ones that can be made by injection molding can be used.

In another embodiment, housing 135 can have a diameter suitable for tipping paper to attach the housing in end-to-end relation with a tobacco rod or filter component. Alternatively, housing 135 can be encased in a sleeve prior to being incorporated into a filter rod.

Filter material can be utilized within a pressure sensitive sealed filter within the sealed portion and/or surrounding the sealed portion. For example, steps 250, as illustrated in FIG. 2, and/or material surrounding housing 135 can be made of filter material, wherein the filter material can be any of the variety of fibrous materials suitable for use in tobacco smoke filter elements. Typical fibrous materials include cellulose acetate, polypropylene or paper. Preferably, the filter material is cellulose acetate.

In addition to providing one or more sealed filters in a smoking article; one or more non-sealed filters can also be included along with the one or more sealed filters. For example, a cigarette can include a non-sealed cellulose acetate filter in series with and adjacent to a sealed filter. Alternatively, a cigarette can include a non-sealed plug-space-plug filter with sorbent in the space, wherein the non-sealed filter can be located upstream from a flavor containing sealed filter. When a smoker breaches the seals of the sealed filter, mainstream smoke can be treated first by the non-sealed filter, including interaction with the plugs and the sorbent in the space, and then second by the flavor available in the breached cavity. Such arrangement would allow for the filtration of the cigarette smoke to be accomplished by the sorbent, and for the flavor to be disposed within the sealed filter without the effectiveness of the flavor being diminished by absorption or adsorption by the sorbent prior to rupturing or breaking the seals surrounding the flavor in the sealed filter.

The filters and/or tobacco rod may also be ventilated to alter the smoke composition and/or resistance to draw. Additionally, the filters can also include additional additives and/or sorbents (i.e., outside of the sealed cavity) in addition to those in the one or more sealed cavities, if desired.

Additives

As mentioned above, additives can be included within one or more cavities of a pressure sensitive sealed filter. As mentioned above, one of the additives that can be sealed within a pressure sensitive sealed filter includes additives and/or sorbents. Any appropriate additive or combination of additives, which modifies the characteristics of a cigarette when the cigarette is smoked, may be contained inside one or more cavities of one or more sealed filters. Such additives can include, but are not limited to flavors, neutralizing agents, chemical reagents like 3-aminopropylsilyl (APS), catalysts, diluents, and sorbents.

In an exemplary embodiment, the additives may include one or more flavors, such as liquid or solid flavors and flavor formulations or flavor-containing materials. Flavors may include any flavor compound or tobacco extract suitable for being releasably disposed within one or more pressure sensitive sealed filters to enhance the taste of mainstream smoke produced by a cigarette. Suitable flavors or flavorings include, but are not limited to, menthol, mint, such as peppermint and spearmint, chocolate, licorice, citrus and other fruit flavors, gamma octalactone, vanillin, ethyl vanillin, breath freshener flavors, spice flavors such as cinnamon, lemon oil, ginger oil, and tobacco flavor.

In another exemplary embodiment, the additives can be a chemical reagent, as mentioned above. Such additives may include, by way of example, chemical additives which interact with the one or more constituents in mainstream smoke. For example, see commonly assigned U.S. Pat. Nos. 6,209,547 and 6,595,218, which discuss reagents which can interact with and can remove gaseous constituents of mainstream smoke, and are expressly incorporated herein by reference in their entireties.

In another exemplary embodiment, the additives can be catalysts. Such catalysts include, but are not limited to, metals and metal oxides, such as tin, platinum, palladium and mixtures thereof, as well as oxides of iron, copper, silver, manganese, titanium, zirconium, vanadium and tungsten.

In another exemplary embodiment, the additives can be diluents. Such diluents include, but are not limited to, glycerin, triacetin, propylene glycol, polyethylene glycol, triethylene glycol, and the like.

As mentioned above, one of the additives that can be sealed within a pressure sensitive sealed filter includes sorbents for sorption of gas phase constituents of mainstream smoke. As used herein, the term "sorption" denotes filtration by adsorption and/or absorption. Sorption is intended to encompass interactions on the outer surface of the sorbent, as well as interactions within the pores and channels of the sorbent. In other words, a "sorbent" is a substance that may condense or hold molecules of other substances on its surface, and/or take up other substances, i.e., through penetration of the other substances into its inner structure, or into its pores.

Sorbents can be adsorbents, absorbents, or substances that may perform both of these functions. For example, sorbents can be provided as sorbent particles of about 0.3 mm to about 0.85 mm or 20 to 50 mesh size to facilitate loading into cavities of cigarette filters, as well as to achieve a desirable filter pressure drop or resistance to draw. Sorbents can also be used in other forms in cigarette filters other than within a cavity, e.g., sorbent particles may be distributed in the filamentary tow and in that form may be also be sealed within a pressure sensitive sealed filter.

While any suitable material may be used as a sorbent, preferred embodiments include activated carbon or microporous materials with pores having widths, for example, of less than about 20 Å. The sorbent may be any material which has the ability to absorb and/or adsorb gas constituents on the surface thereof or to assimilate such constituents into the body thereof. By way of example, sorbent materials may include, but are not limited to, carbons such as activated carbon, aluminas, silicates, molecular sieves, and zeolites and may be used alone or in combination.

While sorbents are useful for filtering cigarette smoke, sorbents may also hinder a cigarette designer's ability to add other additives, such as flavor additives. In particular, sorbents tend to adsorb and/or absorb the flavor additives during the time between cigarette manufacture and use by the consumer, thus reducing the effectiveness of the flavor additives in the cigarette.

In addition to the reduction of the effectiveness of the flavor additives due to the adsorption/absorption by the sorbents, two additional problems may also be encountered if flavor additives are provided along with sorbent. First, the flavor additives may occupy active sites in the sorbent; thereby reducing the sorbent's ability to remove targeted gas phase constituents from smoke. Second, the flavor additives can be so strongly adsorbed/absorbed by the sorbent, that the flavor additives may not be sufficiently releasable into mainstream smoke. As such, separation between the sorbents and flavor additives (or other additives) by using more than one cavity in a sealed filter is desirable.

In order to provide additives within one or more cavities of a sealed filter, additives can be placed within the one or more cavities before or after one or more films are placed in the filter. For example, a first side of a cavity can be sealed with a film, then the additives can be placed within the cavity, and then the second side of the cavity can be sealed with another film. Alternatively, additives can be placed within a cavity, and then both sides of the cavity can be sealed with films.

In an exemplary method of filling the filter 200, as illustrated in FIG. 2, first a housing 135 can be provided with steps 250 therein. Next, a third optional screen 175 can be fitted on step 250 to close one end of cavity 180. It is noted that the screen 175 can be provided such that the screen 175 can substantially prevent the additives from escaping from this side of the cavity 180. Next, the cavity 180 can be filled with additives, such as sorbents, and then an optional second screen 170 can be placed on the opposite end of the cavity 180 such that the additives can be substantially prevented from escaping from this side of the cavity 180.

After placing screens 170, 175 on either side of the cavity 180 to substantially prevent additives from escaping, the cavity 180 can be sealed to substantially prevent interaction of the additives with the remainder of the cigarette and the environment by sealing the filters using films 160, 165. In FIG. 2, the films 160, 165 are placed next to the screens 170, 175. Additionally, as illustrated in FIG. 2, the films 160, 165 are placed within the stepped portions 250, wherein the stepped portion 250 can assist in holding the films 160, 165 in place.

Also, as illustrated in FIG. 2, an optional first screen 150 and an optional fourth screen 155 can also be provided next to the films 160, 165 to protect the films during manufacturing and from the cigarette and substantially prevent the films 160, 165 (or portions broken off from the films 160, 165) from escaping the filter after the films 160, 165 are breached. Additionally, the optional fourth screen 155 and the optional second screen 170 can include pins 210 or the like on to assist in breaching films 160, 165 when a smoker draws on the filter 200.

While the invention has been described in detail with reference to specific embodiments thereof, it will be apparent to those skilled in the art that various changes and modifications can be made, and equivalents employed, without departing from the scope of the appended claims.

What is claimed is:

1. A cigarette, comprising:

a tobacco rod;

a sealed filter adjacent to a downstream end of the tobacco rod, wherein the sealed filter comprises:

a housing with a stepped inner profile;

a cavity within the housing;

a first film sealing an upstream end of the cavity on a first step of the stepped inner profile; and a second film sealing a downstream end of the cavity on a second step of the stepped inner profile, wherein the cavity is located between the first film and the second film sealing a downstream end of the cavity; and tipping paper attaching the tobacco rod to the sealed filter, wherein the sealed filter further comprises: a first screen upstream of the first film; a second screen downstream of the first film; a third screen upstream of the second film; and a fourth screen downstream of the second film.

2. The cigarette of claim 1, wherein each of the screens are located on a stepped portion of the housing, and/or wherein the screens are attached to the housing by mechanical attachment or chemical bonding.

3. The cigarette of claim 1, wherein the sealed filter further comprises:

one or more additives within the cavity of the filter, wherein the one or more additives comprise flavors, neutralizing agents, chemical reagents, catalysts, sorbents, and/or diluents.

4. The cigarette of claim 1, further comprising at least one piercing device operable to pierce the first film and/or the second film upon a suction force being applied to a downstream end of the filter.

5. The cigarette of claim 1, wherein the first film and/or the second film comprise:

an elastomeric polymer; and/or a scored film.

6. The cigarette of claim 1, wherein the housing, the first film and the second film are of non-permeable material.

7. The cigarette of claim 1, wherein:

the sealed filter further comprises at least one additional cavity, and at least one additional film; and/or the cigarette further comprises at least one additional sealed filter and/or at least one non-sealed filter.

8. A sealed cigarette filter, comprising:

a housing;

a cavity within the housing;

a first film on a first side of the cavity;

a second film on a second side of the cavity;

at least one piercing device located next to the first film and/or the second film;

a first screen located adjacent to the first film;

a second screen located adjacent to the first film and on the opposite side of the first film from the first screen;

a third screen located adjacent to the second film; and a fourth screen located adjacent to the second film and on the opposite side of the second film from the third screen, wherein one of the at least one piercing device is located on the second screen and wherein a second one of the at least one piercing device is located on the fourth screen.

9. The sealed cigarette filter of claim 8, wherein the at least one piercing device comprises a pointed pin that pierces the first film and/or the second film to rupture the first film and/or the second film, respectively.

10. The sealed cigarette filter of claim 8, further comprising:

additives within the cavity of the filter, wherein the additives comprise flavors, neutralizing agents, chemical reagents, catalysts, sorbents, and/or diluents.

11. The sealed cigarette filter of claim 8, wherein the first film and/or the second film comprise:

an elastomeric polymer; and/or a scored film.

12. The sealed cigarette filter of claim 8, wherein the housing, the first film and the second film are non-permeable.

13. The sealed cigarette filter of claim 8, further comprising:

at least one additional cavity; and at least one additional film.

14. A method of treating tobacco smoke produced by the cigarette of claim 3, comprising:

drawing on the cigarette so as to rupture the first film and the second film;

lighting or heating the tobacco rod to form smoke; and drawing the smoke through the cavity, wherein the additives therein interact with the smoke.

* * * * *